US005271312A

United States Patent [19]

Lishness et al.

[11] Patent Number: 5,271,312

[45] Date of Patent: Dec. 21, 1993

[54] LOCATING SPRING AND PLUNGER ASSEMBLY FOR A FIREARM

[75] Inventors: Bryant L. Lishness, Bristol; Paul A. Scirica, East Hampton, both of Conn.

[73] Assignee: Colt's Manufacturing Company Inc., West Hartford, Conn.

[21] Appl. No.: 627,596

[22] Filed: Dec. 14, 1990

[51] Int. Cl.[5] ..... F41A 3/12

[52] U.S. Cl. ..... 89/196; 89/14.05; 42/76.01

[58] Field of Search ..... 89/196, 163, 14.3, 14.4, 89/14.05; 42/75.01, 76.01

[56] References Cited

U.S. PATENT DOCUMENTS

| | | | |
|---|---|---|---|
| 882,594 | 3/1908 | Talbot . | |
| 1,200,872 | 10/1916 | Rosebush | 89/196 |
| 2,495,428 | 1/1950 | Simonson et al. | 89/195 |
| 2,859,444 | 11/1958 | Reymond | 89/14.4 |
| 3,589,226 | 5/1971 | Shadowens, Jr. | 83/143 |
| 3,678,800 | 7/1972 | Seidel et al. | 29/147 |
| 3,731,590 | 5/1973 | Zimmerman, Jr. | 89/163 |
| 3,978,762 | 9/1976 | Khaidurov et al. | 89/14.3 |
| 4,489,515 | 12/1984 | Numbers | 42/1 R |
| 4,646,619 | 5/1987 | Sokolovsky | 89/145 |
| 4,887,510 | 12/1989 | Wynn | 89/163 |
| 5,050,480 | 9/1991 | Knight, Jr. et al. | 89/147 |

FOREIGN PATENT DOCUMENTS

| | | | |
|---|---|---|---|
| 0752307 | 9/1933 | France . | |
| 0983846 | 6/1951 | France . | |
| 405318 | 8/1943 | Italy | 89/14.3 |
| 0224674 | 3/1943 | Switzerland . | |

*Primary Examiner*—Stephen M. Johnson
*Attorney, Agent, or Firm*—Perman & Green

[57] ABSTRACT

A spring and plunger assembly for use with a barrel bushing and slide of a firearm for axially positioning the bushing and slide relative to each other. The bushing has a frame with a locking plunger hole. Located in the plunger hole is a coiled spring with a plunger connected thereto. The coiled spring has a first end that has a tight coil shape that is frictionally mounted over an end shank of the plunger. The coiled spring also has a second end with an enlarged coil shape that is compressed and press fit into the plunger hole to frictionally hold the spring and plunger to the bushing.

9 Claims, 1 Drawing Sheet

LOCATING SPRING AND PLUNGER ASSEMBLY FOR A FIREARM

BACKGROUND OF THE INVENTION

1. Field of the Invention

The present invention relates to spring and plunger positioning assemblies and, more particularly, to an assembly for use with a firearm.

2. Prior Art

In the firearms industry, the use of coiled springs and plungers in a hole to position or locate two members relative to each other is well known. The hole is formed in a first member and the spring and plunger are mounted therein. The plunger extends from an aperture of the hole and is movable therein by compressing the spring. In order to prevent the spring and plunger from falling out of the hole, a second hole is drilled into the first member, transverse to the first hole, and a limiting pin is inserted to limit the forward motion of the plunger. The second member usually has a detent notch that the forward end of the plunger can extend into. This prevents the two members from moving relative to each other except as otherwise provided and, the plunger can be pushed back into the hole, compressing the coil spring, to allow for disengagement of the two members.

A problem exists with spring and plunger positioning systems in the prior art in that, due to the exterior shapes of the parts of the firearm, it is sometimes relatively expensive to drill the second hole that is intended to hold the retaining pin. A curved exterior surface may require actually drilling a pre-hole surface such that the second hole can be drilled straight. This obviously increases the cost of manufacturing the firearm.

A further problem exists with the three piece positioning system in the prior art in that the retaining pin hole disturbs the exterior appearance of the firearm and is a collection point for dirt. It also makes disassembly of the system very difficult and thus, makes cleaning of the spring and plunger very difficult.

It is therefore an objective of the present invention to provide a new and improved spring and plunger locating system for a firearm.

SUMMARY OF THE INVENTION

The foregoing problems are overcome and other advantages are provided by a new and improved spring and plunger assembly and method of manufacturing the same.

In accordance with one embodiment of the present invention, a barrel bushing for a firearm is provided having a frame, a coiled spring and a plunger. The frame has a barrel bore and a locking plunger hole. The coiled spring has a center channel and is located in the locking plunger hole. The plunger is located in the hole and at least partially extends therefrom. The plunger has a rear end with a shank section and a front end. The shank section is suitably sized and shaped to fit inside the centered channel of the coiled spring and be retained therewith.

In accordance with another embodiment of the present invention in a firearm having a frame, a barrel, a slide, and a barrel bushing, the barrel bushing having a housing with a locking detent hole and a coil spring therein, the improvement comprising a detent plunger located in the locking detent hole having a front base extending from the hole and adapted to be positioned in a detent recess in a front face of the slide, and a rear end adapted to be positioned in a centered channel of the coil spring and be connected therewith.

In accordance with one method of the present invention, a method of manufacturing a barrel bushing for a firearm is provided. The method comprises the steps of providing a frame with a barrel bore and a detent hole, preventing a detent plunger with a front end adapted to be positioned in a detent recess of a slide and a rear end with means for connecting a spring thereto, providing a coiled spring, connecting the coiled spring to the rear end of the plunger, and inserting the spring and plunger into the detent hole with the front end of the plunger extending, at least partially, out of the hole.

In accordance with another embodiment of the present invention, a plunger and spring assembly for use in a hole of a firearm for locating two members relative to each other is provided. The assembly comprises a plunger with a rear end shank, and a coiled spring. The coiled spring has a first end portion connected to the shank and a second portion suitably sized and shaped to be compressed into the hole to frictionally hold the spring and plunger, at least partially, in the hole.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
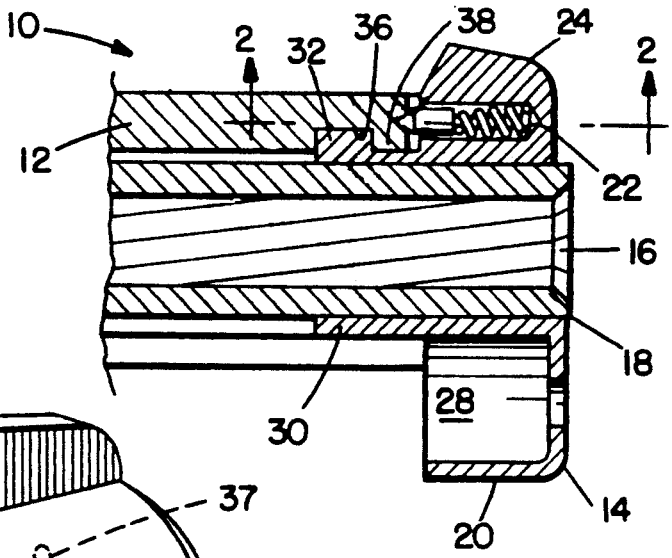
FIG. 1 is a partial cross sectional view of the forward end of the firearm incorporating features of the present invention.

Referring to FIG. 1, there is shown a partial cross-sectional view of the front end of the pistol 10 having a slide 12 and barrel bushing 14 incorporating features of the present invention. Although the present invention will be described with reference to the slide 12 and barrel bushing 14 of the pistol 10, it should be understood that the present invention can be used in any suitable type of firearm for positioning or locating any type of two members relative to each other. In addition, any suitable size, shape or type of materials or elements can be provided.

Figure 4:
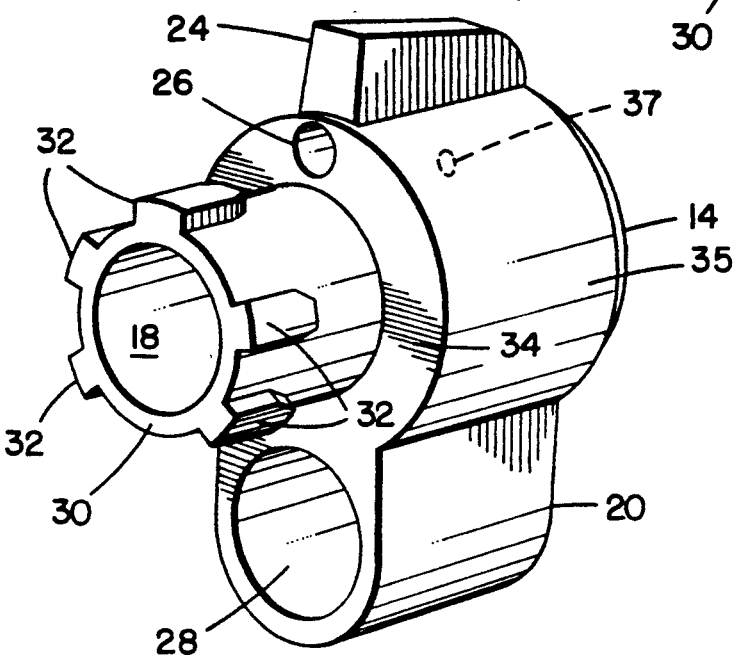
FIG. 4 is a rear end side perspective view of the barrel busing housing shown in FIG. 1.

The pistol 10 has a barrel 16 with a front end located in a barrel bore 18 of the barrel bushing 14. The pistol 10 is similar to a pistol disclosed in U.S. patent application Ser. No. 447,601 filed Dec. 8, 1989 which is incorporated by reference in its entirety herein. Referring also to FIG. 4, a perspective view of the frame 20 of the barrel bushing 14 is shown. The barrel bushing 14 generally comprises the frame 20 and a positioning or locating assembly 22. The frame 20, in the embodiment shown, is a unitary member comprised of a suitable material such as metal. However, any suitable type of material could be used including plastic or multiple members connected together. The frame 20 has a front sight 24 on its top, a locking plunger hole or positioning assembly hole 26, barrel bore or hole 18, return spring recess 28, and a rear extension 30 with locking lugs 32. The locking plunger hole 26, in the embodiment shown, is a blind hole that has been drilled into a rear face 34 of the frame 20. The rear extension 30 is suitable sized and shaped to fit inside the front of the slide 12. The slide 12 has channels 36 into which the locking lugs 32 can be positioned and then the frame 20 can be axially turned with the locking lugs 32 thus being positioned behind stops 38 in the slide 12 to prevent the barrel bushing 14 from being removed from the slide 12 without first axially rotating the barrel bushing 14 relative to the slide 12.

Figure 3:
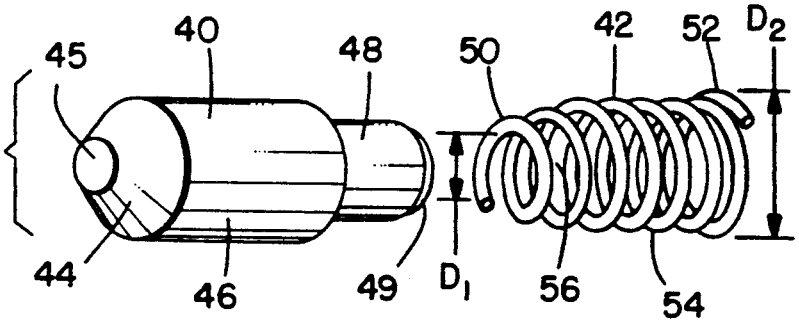
FIG. 3 is an exploded perspective view of the plunger and coil spring shown in FIG. 2.
Figure 2:
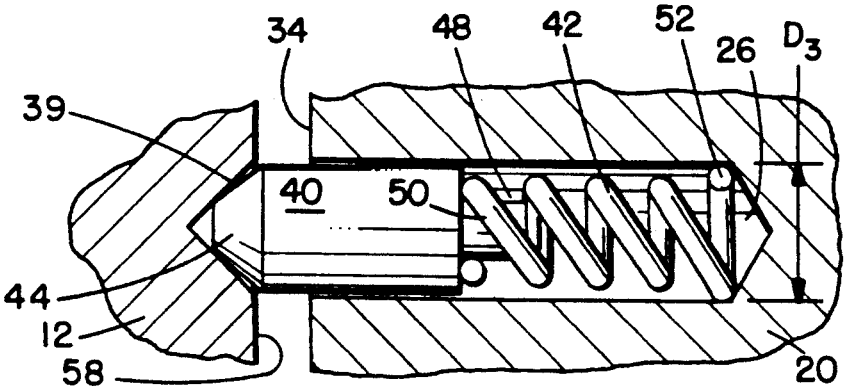
FIG. 2 is a cross sectional view of the firearm shown in FIG. 1 taken along line 2—2.

Referring now also to FIGS. 2 and 3, the positioning assembly 22, in the embodiment shown, generally comprises a detent plunger 40 and a spring 42 comprised of a coiled member. The plunger 40 has a cone shaped front end 44, a general column shaped body 46, and a rear end 48 forming a shank section. The plunger 40 is preferably a unitary member made of metal. However, any suitable material could be used. The shank section 48 has a beveled tip 49 for aiding the mounting of the spring 42 to the rear end shank section 48. The cone shaped front end 44, in the embodiment shown, has a flat tip 45 and the sides of the cone shape are angled at about 95 degrees. However, any suitable tip shape could be provided. The front end 44 is generally intended to be cooperatable with a detent notch 39 located in the front face 58 of the slide 12 which, in the embodiment shown, is provided as a cone shaped recess with sides angled at about 100 degrees. However, any suitable type of detent notch could be provided. The spring 42 has a first end 50, an opposite second end 52, a center spring section 54, and a center channel 56 formed by its general coiled shape. The coil first end 50 has a relatively tight coil shape forming an inner diameter $D_1$ at the front end of the channel 56. The coil second end 52 has a relatively enlarged coil shape forming an outer diameter $D_2$. The center spring section 54 has an outer diameter less than the second end outer diameter $D_2$ and less than the diameter $D_3$ of the plunger hole 26. In the spring's natural state, as shown in FIG. 3 prior to insertion in the hole 26, the second end outer diameter $D_2$ is larger than the hole diameter $D_3$. Also in its natural state, the first end inner diameter $D_1$ is smaller than the outer diameter of the plunger shank section 48.

In order to install the positioning assembly 22 with the bushing frame 20 only two steps are necessary. First, the plunger 40 and spring 42 are connected to each other. The connection is provided as a press fit friction hold connection between the spring first end 50 and the shank section 48. Basically, the first end 50 is positioned at the beveled tip 49 and pressed onto the shank section 48. Because the first end inner diameter $D_1$ is less than the outer diameter of the shank section 48, the coiled spring expands as it is press fit onto the shank section 48 thereby enlarging its inner diameter at the first end 50. This deformation of the first end 50 causes the coil to grip the shank section 48 and be frictionally held thereto. In alternate embodiments, additional or alternative means for connecting the plunger and spring might be provided. Once the plunger and spring are connected to each other, the second step is to merely insert the plunger and spring into their mounting hole 26. The second end 52 of the spring 42 is placed at the opening to the hole 26 and pressed into the hole 26 by pressing on the plunger 40. Because the second end outer diameter $D_2$ is larger than the diameter $D_3$ of the hole 26, the coiled spring 42 must be compressed, decreasing the size of its outer diameter $D_2$ at the second end 52, and press fit into the hole 26. In a preferred embodiment, this compression results from the pushing of the spring second end 52 at the opening of the hole 26 wherein the curved cross-sectional shape of the coiled member cams or wedges the second end 52 into the hole 26 at its opening. However, in an alternate embodiment, additional or alternative means could be provided to compact or compress the outer diameter of the spring second end 52. Once the spring second end 52 is initially inserted into the hole 26, the plunger 40 is still pushed until the second end 52 contacts the rear end of the hole 26. The plunger 40 is then released. This results in the spring 42, which was longitudinally compressed during the insertion process, expanding to position the plunger 40 in the opening to the hole 26 and partially extending from the front of the hole 26. The spring second end 52 attempts to resume its natural outer diameter $D_2$, but is contained by the frame 20 in the hole 26 to form a friction hold of the spring 42 with the frame 20. Since the spring 42 and plunger 40 are connected to each other, the entire spring and plunger assembly 22 is thus connected to the bushing frame 20. Although a press fit friction hold between the spring second end 52 and frame 20 is described above, it should be understood that additional or alternative means for connecting the assembly 22 to the frame 20 may be provided.

With the assembly 22 connected to the frame 20, the barrel bushing 14 is ready to be connected to the pistol slide 12. After connection of the bushing 14 to the slide 12, the bushing and slide can be assembled with the remainder of the pistol. In order to connect the bushing 14 to the slide 12, the rear extension 30 is positioned into the front end of the slide 12 with legs 32 passing through a first section of the lug channels 36. This positioning occurs with the bushing 14 being axially offset a predetermined angle from its intended final position. The rear face 34 of the bushing frame 20 is pressed next to the front face 58 of the slide 12 with the extending portion of the plunger 40 being pushed back into the hole 26, at least partially. The center spring section 54 is able to deform in the hole 26 such that its length is shortened and stores potential energy. The bushing 14 is then axially rotated relative to the slide 12 to its final intended position. As the slide and bushing are axially rotated relative to each other, the locking lugs 32 laterally move in a second section of the lug channels 36 to positions behind the stops 38. As the slide 12 and bushing 14 reach their final intended position, the detent notch 39 on the front face 58 of the slide 12 aligns with the hole 26 in the bushing 14. This allows the plunger 40 to be pushed partially out of the hole 26 from its retracted position by the spring 42. The front end 44 of the plunger 40 moves into the detent notch 39 in the slide 12, but a portion of the plunger body 46 remains in the hole 26. With the plunger 40 thus positioned, the assembly 22 provides the function of preventing axially rotation of the slide and bushing relative to each other during normal use of the pistol, but which can also allow for relatively simple disassembly of the two members.

In order to disassemble the slide 12 and bushing 14, a sufficiently large torque must be applied to the slide and bushing to allow the cone shaped sides of the detent notch 39 to wedge the plunger 40 out of the notch 39 and back into the hole 26, at least partially. Once the plunger 40 is moved out of the detent notch 39, the slide and bushing can be further rotated to move the locking lugs 32 out from behind the stops 38 and then the bushing and slide can be axially pulled apart. The friction mounting of the positioning assembly 22 with the frame 20 allows the assembly 22 to stay assembled with the frame 20 unless and until the assembly 22 is intentionally pulled out of the hole 26 for cleaning or replacement. In a preferred embodiment, the friction holding force between the plunger 40 and spring 42 is sufficiently larger than the friction holding force between the spring 42 and frame 20 such that when the plunger 40 is pulled from the frame 20, the spring 42 is pulled with the plunger and does not stay in the hole 26. The spacing between the two faces 58 and 34 shown in FIG. 2 is exaggerated for the sake of clarity. However, any suitable spacing could be provided so long as a sufficient length of the body 46 of the plunger 40 is contained in hole 26 that can withstand the load applied to the plunger by the slide 14.

The advantages of the present invention should be readily evident to a person skilled in the art. First, unlike the prior art plunger and coil spring locators, the present invention does not need an additional retaining pin to prevent the plunger and spring from falling out of their hole when the weapon is disassembled. This eliminates the need to drill the retaining pin hole in the frame and, when the frame has an irregular surface such as curved side 35 this eliminates the need for machining a pre-drilling surface. (See FIG. 4 where the location of the retaining pin hole 37 would otherwise need to be drilled shown in dashed lines). This obviously reduces the cost of the firearm. In addition, the retaining pin system of the prior art was difficult to clean and disassemble. The pin hole 37 also disturbed the continuity of the visual appearance of the firearm. The present invention does not need a retaining pin and thus, there is no need for a retaining pin hole. The disassembly of the assembly 22 from the frame 20 is relatively simple and easy, as is reassembly. This allows for easier cleaning. The plunger and spring assembly of the present invention can be used in any suitable location for positioning two members relative to each other.

Let it be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A barrel brushing for a firearm comprising:

a frame having a barrel hole and a locking plunger hole;

a coiled spring forming a center channel and being located in said plunger hole;

a plunger located in said plunger hole and at least partially extending therefrom, said plunger having a rear end with a shank section and a front end, said shank section being suitably sized and shaped to fit inside said center channel of said coiled spring; and means for connecting said coiled spring to said plunger comprising said coiled spring having a first end with said center channel being smaller than said shank section such that said coiled spring is expanded onto said shank section to friction hold said spring to said plunger.

2. A barrel bushing as in claim 1 wherein said frame further comprises means for mounting said frame to a slide of the firearm.

3. A barrel bushing as in claim 1 wherein said coiled spring has a second end with an outer diameter larger than said plunger hole that is compressed into said plunger hole to friction hold said spring in said plunger hole.

4. A barrel bushing as in claim 1 further comprising means for connecting said spring to said frame.

5. In a firearm having, a barrel, a slide, and a barrel bushing, the barrel bushing having a housing with a locking detent hole and a coil spring therein, the improvement comprising:

a detent plunger located in the locking detent hole having a front face extending from the hole and adapted to be positioned in a detent recess in a front face of the slide, and a rear end adapted to be positioned in a center channel of the coil spring and be connected therewith, said rear end being slightly larger than the size of the center channel of the coil spring at said rear end to friction hold said spring on said rear end.

6. A method of assembling a barrel bushing for a firearm comprising steps of:

providing a frame with a barrel hole and a detent hole;

providing a coiled spring;

providing a detent plunger with a front end adapted to be position in a detent recess of a slide and a rear end with means for connecting the spring thereto;

connecting the coiled spring to the rear end of the plunger; and inserting the spring and plunger into the detent hole with the front end of the plunger extending, at least partially, out of the detent hole, the step of providing the coiled spring comprising forming the spring with a front end having a coil inner channel smaller than the plunger rear end.

7. A method as in claim 6 wherein the step of providing the detent plunger comprises providing the plunger with a rear end shank.

8. A method as in claim 6 wherein the step of providing the coiled spring comprises providing the spring with a rear end having a coil outer shape larger than the detent hole.

9. A barrel bushing for a firearm comprising:

a frame having a barrel hole and a locking plunger hole;

a coiled spring located in said locking plunger hole;

a plunger located in said locking plunger hole and at least partially extending therefrom, said plunger being connected to said coiled spring; and means for connecting said coiled spring to said frame, said coiled spring having an outer diameter portion larger than said plunger hole that is compressed into said plunger hole to friction hold said coiled spring in said plunger hole.

* * * * *